United States Patent [19]

Bollen

[11] Patent Number: 4,944,077

[45] Date of Patent: Jul. 31, 1990

[54] WINDING MACHINE WITH REDUCED YARN RUN RESISTANCE AND METHOD OF REDUCING THE YARN RUN RESISTANCE

[75] Inventor: Manfred Bollen, Oberuzwil, Switzerland

[73] Assignee: Benninger AG, Uzwil, Switzerland

[21] Appl. No.: 301,479

[22] Filed: Jan. 25, 1989

[30] Foreign Application Priority Data

Feb. 5, 1988 [CH] Switzerland ..... 417/88

[51] Int. Cl.[5] ..... D02H 13/22; D02J 7/00; B65H 49/00

[52] U.S. Cl. ..... 28/173; 28/199; 15/312 R

[58] Field of Search ..... 15/312 R; 28/199, 173

[56] References Cited

U.S. PATENT DOCUMENTS

| | | | |
|---|---|---|---|
| 2,729,845 | 1/1956 | Miller et al. | 15/312 |
| 3,317,979 | 5/1967 | Furst | 28/199 |
| 3,667,093 | 6/1972 | Culpepper, Jr. | 28/173 |

*Primary Examiner*—Werner H. Schroeder
*Assistant Examiner*—Bradley Kurtz DeSandro
*Attorney, Agent, or Firm*—Shoemaker and Mattare, Ltd.

[57] ABSTRACT

The invention relates to a winding machine, in particular a warping or beaming machine, in which yarns are drawn off a bobbin creel at high speed. To reduce the air friction of the yarns and to improve the removal of fiber contaminating material, there is provided an arrangement for accelerating the air which surrounds the yarns. In addition it is possible to provide an extractor hood with which the air is sucked out of the region of the winding unit and recirculated to the said arrangement.

9 Claims, 1 Drawing Sheet

Fig 1
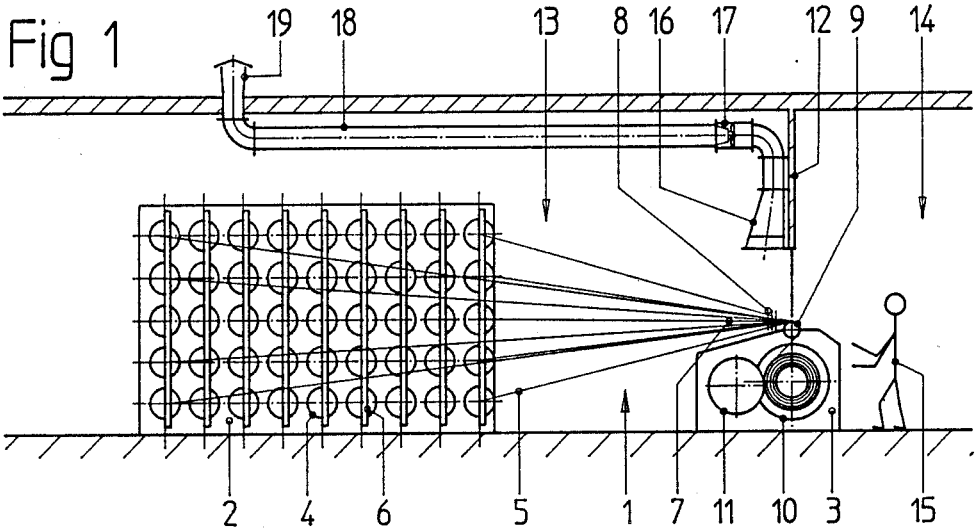
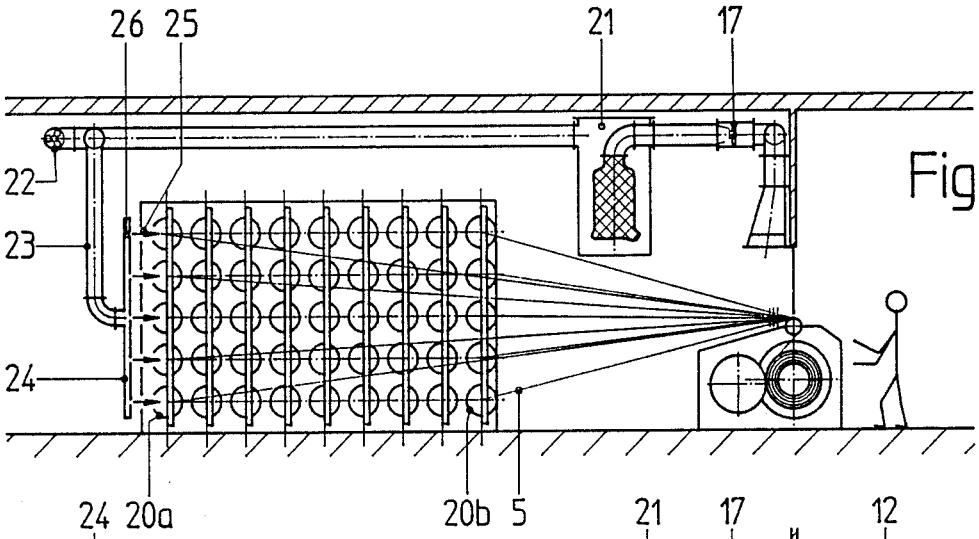
Fig 2
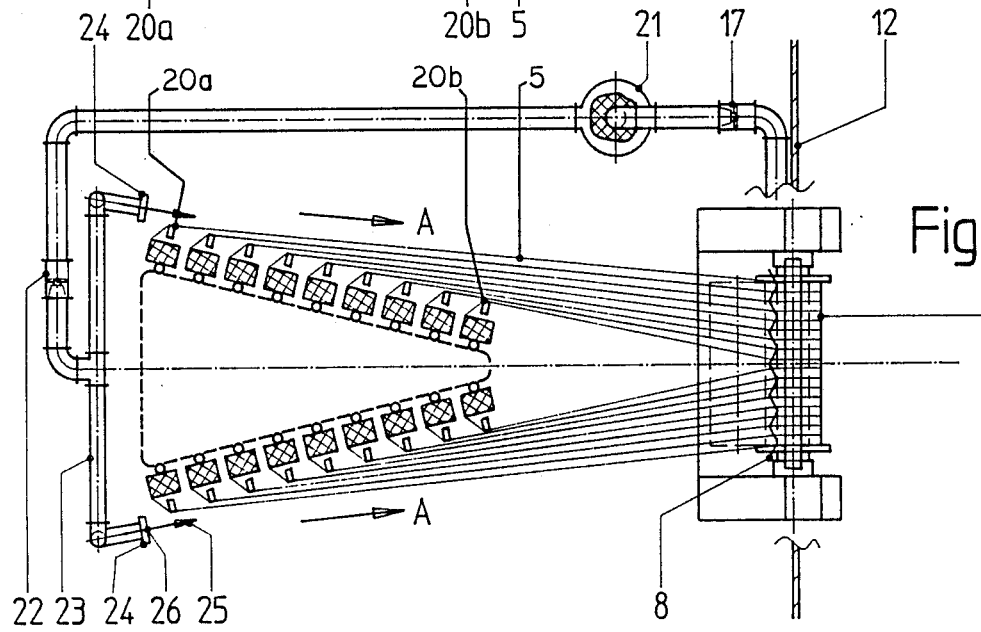
Fig 3

WINDING MACHINE WITH REDUCED YARN RUN RESISTANCE AND METHOD OF REDUCING THE YARN RUN RESISTANCE

FIELD OF THE INVENTION

The invention relates to a winding machine, in particular a warping or beaming machine in which yarns are drawn at high speeds from bobbins, in particular a bobbin creel and guided to a beam over a substantial distance and a method of reducing the resistance to movement of such yarns.

In warping or beaming machines, yarns are drawn off at high speeds in the region of for example 1000 meters per minute and, depending on the particular kind of installation, wound on to a warping beam or directly on to the weaving beam. On the one hand, the high yarn run speeds result in strong air currents being produced, which are directed from the bobbin creel towards the winding machine. On the other hand, in particular the yarns from the rear most rows of bobbins of a bobbin creel, which have to cover the greatest distance to the winding unit, are subjected to a strong braking action due to the friction of the air. That also results in particular in uneven yarn tensioning. For that reason, auxiliary means such as for example bars around which the yarns pass are conventionally frequently used, in order artificially to adapt the yarns which are drawn from the front rows of bobbins to the increased level of yarn tensioning of the yarns which are drawn from the rearward rows.

DESCRIPTION OF THE PRIOR ART

In order to keep the comb free of flying dust, German Patent Specification No. 1073973 already discloses a dust removal device in which the comb is cleaned from below by a blast of air which is sucked away again by a hood above the comb and is blown through passages downwardly concentrically on to the middle of the warping creel. The circulating air is therefore firstly directed at a right angle to the yarn run direction and is then changed in its direction and entrained by the warp yarns which are moving at high speed.

SUMMARY OF THE INVENTION

The object of the invention is to provide a winding machine and a method of the kind set forth in the opening part of this specification, in which the resistance to movement of the yarns can be reduced in a manner which is simple from the point of view of structure and which can be adapted to the operating speed of the winding machine. At the same time the invention seeks to provide that the steps of removing dust by suction and cleaning air in the region of the yarn guide means (for example also at the creel) are improved.

In accordance with the invention those objects are achieved by a winding machine provided with an arrangement for accelerating the air surrounding the yarns, substantially in the yarn run direction. That is the method in which a flow of air in the yarn run direction is produced at least over a part of the distance covered by the yarns. It will be seen that the friction of the air against the yarns is reduced or even entirely eliminated by virtue of the acceleration of the layers of air surrounding the yarns, or the production of a flow of air in the yarn run direction. In that respect the flow of air in the region of the array of yarns is produced not only by the yarns themselves but by the novel arrangement for producing acceleration of the air. In particular the yarn tension in respect of the yarns which are drawn off the rearmost rows of bobbins and which at the same time are the outermost yarns of an array of yarns is reduced thereby and brought closer to the tension of the yarns which have a shorter distance to cover when they are drawn off the respective bobbins.

The air flow can be produced in a particularly simple fashion if the arrangement has a nozzle or nozzles, the outlet openings of which are directed in the yarn run direction.

The arrangement may be adapted to different forms of creels and in particular can also be easily adjusted if a plurality of nozzles are mounted on a nozzle holdings means.

The accelerated air can be supplied in a structurally simple fashion by the nozzle holding means being a nozzle bar which is supplied by a distribution conduit. In that arrangement the spacing of the nozzles on the nozzle bar corresponds to the spacing of the bobbins of a row thereof so that at least one nozzle can be associated with each horizontal row of bobbins in a bobbin creel.

The invention can be carried into effect in a particularly desirable and structurally simple fashion if the nozzles are provided primarily for accelerating the air in the region of the yarns which are drawn from the rearmost row of bobbins in a bobbin creel. In that way air with the highest level of acceleration, namely at the nozzle outlet, is directed primarily on to the yarns which are furthest away from the winding unit. In addition, in such an arangement the air can flow along the outwardly disposed yarns of an array of yarns and reduce the air friction at the location where it has a particular effect. The effect of the arrangement may be further improved if there is provided at least one suction removal means for sucking away dust in the region of the winding unit. In that way the accelerated air and the dust transported by the yarns is transported in a flow of air which extends along the array of yarns, and is sucked away by the winding unit. In addition the flow of air along the path of the yarns or in the array of yarns is increased in strength, thereby further reducing the level of air friction. In that connection the suction removal means may be embodied in a particularly advantageous manner if it has a filter for cleaning the air which is sucked away and is also connected to the air-accelerating arrangement for recycling of the air which is sucked away.

In order to increase the strength of the flow of accelerated air, it may be advantageous additionally to provide an arrangmeent for sucking in and mixing fresh air (that is to say air which is additionally sucked in) with the recycled air. In order to be able to provide for optimum adaptation of the method to an installation and the respective operating speeds used, it is advantageous for the speed of the flow of air to be controllable or regulatable in dependence on the yarn run speed. Such a control effect may be achieved for example by regulating fans or blowers or in some other way by regulating the amounts of air involved, in dependence on the operating speed. It will be appreciated that it is also possible to provide for adjustment of the speed of the air flow, by hand.

It will be seen that in particular the circulation of air from the bobbin creel to the winding unit, for example to the warping comb or the warping beam, also provides in an advantageous fashion that the creel is kept free from particles of dust and the dust can be guided and sucked away in a generally controlled fashion in a flow of air.

DESCRIPTION OF THE DRAWINGS

In order that the invention may be clearly understood and readily carried into effect apparatus in accordance therewith will now be described, by way of example, with reference to the accompanying drawings, in which:

FIG. 1 is a side view of a winding machine which operates for example in accordance with the warping process;

FIG. 2 shows the winding machine of FIG. 1 with an arrangement according to the invention for accelerating the air surrounding the yarns; and FIG. 3 shows a plan view of the arrangement illustrated in FIG. 2.

DESCRIPTION OF A PREFERRED EMBODIMENT

FIG. 1 shows a winding installation 1 which is in the form of a warping or beaming installation. The winding installation 1 has a bobbin creel 2 and for example a warping machine 3. The yarns 5 which are drawn off bobbins 4 each pass through diagrammatically illustrated brake bars 6 which have yarn monitors (not shown). The yarns 5 which are deflected at the brake bars 6 pass to the warping machine 3 in an array of yarns as indicated at 7. The array of yarns 7 is put into order in a warping comb 8 and wound on to a warping beam 10, by way of a measuring roller 9. The winding operation is assisted by a pressure roller 11. Disposed in the region of the warping machine 3 approximately at the location of the warping comb 9 and extending over the entire installation is a portal wall 12 to which auxiliary means (not shown in detail) are secured, such as for example a pivotable draft-protective plate for protecting an operator 15 from dust and draft. In that way the bobbin creel area 13 can be separated to a certain extent from the operator area 14.

Secured to the portal wall 12 is an extractor hood 16 which is connected to a fan 17 which sucks away dust and fibres from the region of the yarn array 7 and delivers it by way of an air conduit 18 to a chimney 19. FIGS. 2 and 3 show a similar winding machine wherein not all the reference numerals from FIG. 1 are repeated, for the sake of enhanced clarity.

As illustrated, the air which is sucked away by the extractor hood 16 and the fan 17 is not discharged to the external atmosphere but is fed by way of an air filter 21 to a distribution conduit 23. The distribution conduit 23 opens into two nozzle bars 24 which are each arranged in the region of the rearmost row **20*a* of bobbins of the bobbin creel 2. Nozzles 26 are arranged at the front side of the nozzle bars 24 in such a way that they blow jets of air 25 in the yarn run direction and in so doing accelerate the air surrounding the yarns 5. In that arrangement, there is a respective nozzle opening 26 for each horizontal row of bobbins 4 so that each of the yarns 5 which are on the outside of the array of yarns 7 has accelerated air flowing therealong. It will be appreciated that, instead of the individual nozzles 26, it is also possible to envisage the provision of one or more slit-type nozzles in order to provide the desired acceleration effect for the air surrounding the yarns 5**.

Control means (not shown) permit the delivery efficiency of the fan 17 to be altered so that the amount and speed of the air flowing out of the nozzles can be adapted to the speed at which the yarns 5 are drawn off the bobbins. For that purpose it may be useful to provide an additional fan 22 which increases the air pressure in the distribution conduit 23 and thus strengthens the air jets 25 issuing from the nozzles. It will be appreciated that, for the purposes of controlling the amount of air issuing in the form of the air jets 25 and the speed of the air jets 25, it is also possible to envisage providing a waste air chimney 19, similarly to the construction shown in FIG. 1, with a part of the air delivered by the fan 17 being caused to blow off to the environment when there is a lower air requirement. That may also be used for example when starting up or shutting down the winding machine, if for example the fan is to remain in operation for a while, for air cleaning purposes, but no discharge for air at the nozzles 26 is required.

In operation the illustrated winding machine takes account of the fact that in particular the yarns 5 in the rearmost row **20*a* of bobbins—which also run on the outsides of the array of yarns 7—are particularly subjected to a braking action due to air friction. In comparison with the yarns 5 in the front and in particular the foremost row 20*a* of bobbins, that gives an increased tension in the yarns, which can also be increased still further by any guide elements (not shown) that may be provided. The differences in yarn tensioning have a disadvantageous effect in the array of yarns 7 or on the warping beam 10. Excessive fluctuations result in second-rate warps or even wastage. In order now to equalise the yarn tension in the array of yarns 7, conventional installations include bars (not shown) for the yarns 5 to pass therearound. In that situation, the yarns in the front rows of bobbins are caused to pass around the bars to a greater extent in order to subject them to a stronger braking effect than the yarns from the rearward rows of bobbins. In order better to adapt the tensions in the yarns from the various rows to each other, the air which in itself is static in the region of the rearmost row of bobbins 20*a* and the adjoining rows of bobbins is accelerated by the air issuing from the nozzles 26 in the direction indicated by the arrow A so that the friction of the air on the yarns 5 is reduced or eliminated. If the air jets 25 are set at a suitable strength, it is even possible to assist in the movement of the yarns in the draw-off direction. The air flow in the direction indicated by the arrow A is supplemented in a particularly advantageous fashion by the action of the extractor hood 16 which sucks away the flow of air which is directed towards the warping machine 3. In that respect the air circulation described above not only contributes to the tension of the yarns in the array of yarns 7 being made more uniform, but it obviously also assists with carrying away the fibre particles which drop off the bobbins 4 and the yarns 5, by way of the extractor hood 16 and the air filter 21. Due to the advantageous circulation of the quantities of air which is sucked away in that way, by way of the fan 17, the air filter 21 and the distribution conduit 23, it is advantageously possible to make a saving on drive power for producing the air jets 25; it will be appreciated however that it would also be possible for the air to be sucked away separately over the warping machine 3, and to feed the nozzle bars 24 by means of an independent installation for producing compressed air. It will be appreciated that, from the point of view of maintaining ambient temperature, the above-described circulation of air by way of the air filter 21 and the distribution conduit 23 is also to be preferred to introducing fresh air to the nozzles 24**.

It will be appreciated that, in addition to the nozzles 26, it is possible to provide still further nozzles, for example inclinedly downwardly and/or inclinedly upwardly, which are directed substantially in the direction of the yarns 5 which are drawn off, and which accelerate the air surrounding same.

I claim:

1. A winding machine comprising a plurality of yarn bobbins each mounted for rotation about its own fixed individual axis, a beam mounted for rotation about a fixed axis located at a substantial distance from each said bobbin axis and arranged to wind thereon an array of yarns while withdrawing said array from said bobbins through an ambient atmosphere of air, and an arrangement for reducing air resistance to the passage of the yarns by accelerating the air velocity sufficiently to substantially reduce the air resistance of the yarn run in the region surrounding said array of yarns, at least partially between the bobbins and the beam and substantially in the yarn run direction toward said beam.

2. A winding machine according to claim 1, in which said arrangement comprises a plurality of nozzles each formed with an outlet opening directed in said yarn run direction.

3. A winding machine according to claim 2, including adjustable holding means for said nozzles whereby the direction of the outlet opening of each said nozzle can be adjusted in the direction of the yarn run.

4. A winding machine according to claim 2, including a distribution conduit for conveying an air stream to an outlet end thereof and a hollow nozzle bar connected to said distribution conduit for receiving said air stream, said nozzles being distributed along said nozzle bar to distribute said air stream towards said array of yarns at spaced locations.

5. A winding machine according to claim 1, in which said yarn bobbins are distributed in a creel with their individual axes substantially horizontal and are arranged in parallel rows located in a notional plane extending away from said beam, said arrangement being located primarily to accelerate the air in the region of the yarns being drawn from the row furthest from said beam when the machine is in operation.

6. A winding machine according to claim 5, in which said arrangement comprises a plurality of nozzles each formed with an outlet opening directed towards the region of said row of bobbins furthest from said beam.

7. A winding machine according to claim 1, in which said yarn bobbins are distributed in a creel with their individual axes substantially horizontal and are arranged in groups of parallel rows, each said group of rows being located in one of a plurality of notional planes extending away from said beam, said arrangement including nozzles located primarily to accelerate the air in the region of the yarns being drawn from the row in each group thereof furthest from said beam when the machine is in operation.

8. A winding machine according to claim 1, including suction removal means mounted for sucking away dust-laden air from the region of said beam, a filter connected to said suction removal means for removal of dust from said dust-laden air thereby providing cleaned air and means connecting said filter to said accelerating arrangement for recycling said cleaned air to said array of yarns.

9. A winding machine according to claim 8, in which said connecting means includes means for drawing in fresh air for mixture with said cleaned air from said filter.

* * * * *